US005681493A

United States Patent [19]

Yoshizuka et al.

[11] Patent Number: 5,681,493

[45] Date of Patent: Oct. 28, 1997

[54] MULTI-LEVEL ENERGY SAVING TEMPERATURE CONTROLLER FOR IMAGE FORMING FIXING UNIT

[75] Inventors: Ken Yoshizuka; Tsukasa Sugiyama; Yoshiaki Tabata, all of Osaka, Japan

[73] Assignee: Mita Industrial Co., Ltd., Osaka-fu, Japan

[21] Appl. No.: 607,982

[22] Filed: Mar. 4, 1996

[30] Foreign Application Priority Data

Mar. 7, 1995 [JP] Japan ..... 7-047424

[51] Int. Cl.[6] ..... H05B 1/02

[52] U.S. Cl. ..... 219/494; 219/506; 219/497; 219/492; 219/216; 355/405

[58] Field of Search ..... 219/492, 497, 219/499, 501, 505, 506, 216, 508; 355/405

[56] References Cited

U.S. PATENT DOCUMENTS 4,145,599 3/1979 Sakurai et al. ..... 219/216
4,551,007 11/1985 Elter ..... 355/14 FU
4,812,625 3/1989 Ceste, Sr. ..... 219/497
5,216,743 6/1993 Seitz ..... 392/490
5,373,141 12/1994 Ko ..... 219/497
5,555,075 9/1996 Fukano et al. ..... 355/208

*Primary Examiner*—Mark H. Paschall
*Attorney, Agent, or Firm*—Jordan and Hamburg

[57] ABSTRACT

A temperature controlling device for controlling the temperature of a heating member of a fixing unit of an image forming apparatus, the heating member being heated by a heater to perform a fixing operation at a predetermined fixing temperature, the temperature controlling device is provided with a controller which is operable to control the heater to selectively keep the temperature of the heating member at a first energy saving temperature smaller than the fixing temperature and a second energy saving temperature smaller than the first energy saving temperature when the fixing operation is suspended.

5 Claims, 2 Drawing Sheets

MULTI-LEVEL ENERGY SAVING TEMPERATURE CONTROLLER FOR IMAGE FORMING FIXING UNIT

BACKGROUND OF THE INVENTION

This invention relates to a temperature controlling device for use in a fixing unit of an image forming apparatus which is able to reduce the energy consumption of the fixing unit.

Generally, an image forming apparatus is operated in such a manner that: a toner image formed in an imaging portion including a photosensitive member is transferred onto a sheet of copy paper being fed from a sheet storage portion to a specified position corresponding to the photosensitive member in a transferring portion; and the copy sheet having the toner image transferred thereon is separated from the photosensitive member in a separating portion has the toner image fixed thereon in a fixing portion and is discharged from the image forming apparatus.

Generally, the fixing unit comprises a heating roller and a pressing roller in view of high-speed image fixing operation and safety, and is operated in a so-called thermal fixing manner. According to the thermal fixing manner, the pressing roller is pressed against the heating roller by a specified pressure when a sheet of copy paper having a toner image transferred thereon passes between the pressing roller and the heating roller. Thereby, the toner image is thermally fixed on the copy sheet due to the heat applied from the heating roller and the pressure applied from the pressing roller. A heater for heating the heating roller has a large heat capacity to prevent a thermal variation of the heating roller during a heating operation. Accordingly, a consumption of electric power of the heater becomes large. On the other hand, frequent is the case that the image forming apparatus is brought into a stand-by state during an on-state of the image forming apparatus, i.e., the fixing unit is not used after a main power source of the image forming apparatus is turned on. During the stand-by state, the heater still keeps on heating the heating roller, which is a waste of energy.

To reduce such energy consumption in the fixing unit during the stand-by state, there has been proposed an image forming apparatus provided with a function of preliminary heating. Such image forming apparatus is constructed in such a manner that the fixing unit enters into a preliminary heating operation when the fixing unit is not in use. During the preliminary heating operation, the heating roller is controlled so that the temperature thereof is lowered to a predetermined temperature i.e., preheat temperature. Thus, an energy consumption of the fixing unit is suppressed.

However, in the image forming apparatus having the function of preliminary heating, the preheat temperature is set at a fixed one level. Accordingly, a time required for the image forming apparatus to return to an operable state where an image formation can be performed in a desirable state after the image formation is designated is unchangeable. As a result, an operator cannot selectively make priority between energy saving and shortening the time required for the apparatus to return to the operable state.

SUMMARY OF THE INVENTION

It is an object of the present invention to provide a temperature controlling device for use in a fixing unit of an image forming apparatus which has overcome the problems residing in the prior art.

It is another object of the present invention to provide a temperature controlling device .for use in a fixing unit of an image forming apparatus which makes it possible for an operator to selectively set a desired energy saving level among a plurality of energy saving levels.

The present invention is directed to a temperature controlling device for controlling the temperature of a heating member of a fixing unit of an image forming apparatus, the heating member being heated by a heater to perform a fixing operation at a predetermined fixing temperature, the temperature controlling device comprising: a controller which is operable to control the heater to selectively keep the temperature of the heating member at a first energy saving temperature smaller than the fixing temperature and a second energy saving temperature smaller than the first energy saving temperature when the fixing operation is suspended.

The controller may be provided with a first designating member for designating the first energy saving temperature; and a second designating member for designating the second energy saving temperature.

The controller may be further provided with a releasing member for releasing of the designation of the first designating member or the second designating member.

With the thus constructed temperature controlling device, the controller can controls the heater so that the heating member has the first energy saving temperature smaller than the fixing temperature and the second energy saving temperature smaller than the first energy saving temperature when the fixing operation is suspended. This will provide an increased selective energy saving temperatures for an image forming apparatus.

The controller is provided with the first and second designating members, thereby assuring easier designation of energy saving temperature. Also, the controller is provided with the releasing member. Accordingly, the fixing unit can be restored to the operable condition easily and rapidly.

The above and other objects, features and advantages of the present invention will become more apparent upon a reading of the following detailed description and drawings.

DETAILED DESCRIPTION OF THE PREFERRED EMBODIMENTS OF THE INVENTION

Figure 2:
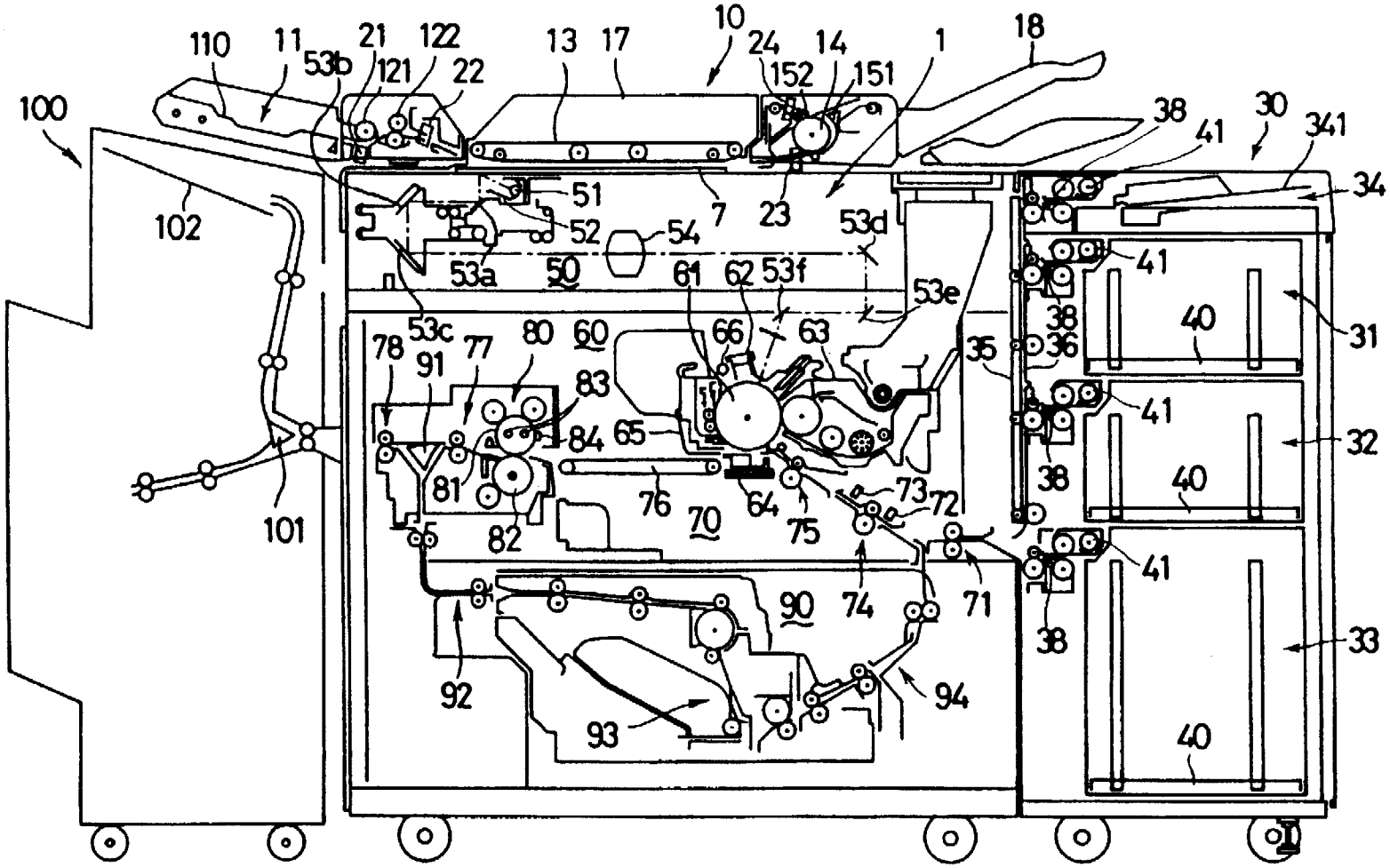
FIG. 2 is a front view showing an internal construction of the image forming apparatus.

An image forming apparatus incorporating a fixing unit provided with a temperature controlling device of the present invention will be described with reference to FIG. 2. FIG. 2 is a front view schematically showing an internal construction of the image forming apparatus.

The image forming apparatus comprises a main body 1, a document transport unit 10, a copy sheet storage portion 30 arranged in a right side thereof, and a sorter 100 arranged in a left side thereof. The document transport unit 10 is arranged in a top portion of the apparatus main body 1 and is also used as a document holder.

The main body 1 comprises a document glass plate 7 at a center on a top surface thereof, and an operation display panel 200 (see FIG. 1) at a front end of the top surface. The main body 1 of the image forming apparatus is internally provided with an optical system 50, an imaging assembly 60, a sheet transport assembly 70, a fixing unit 80, and a duplex copy portion 90.

The document transport unit 10 comprises a document transport assembly 25 (see FIG. 1) including a document feeding roller 121 and a document transport belt 13, a document placing portion 11 arranged at an upstream side of the document transport assembly 25 with respect to a document transport direction, and document discharge portions 17 and 18 arranged at a downstream side of the document transport assembly 25.

The document placing portion 11 includes a document tray 110 and a document sensor 21. A document is placed on the document tray 110 in such a manner that a document image is faced downward facing the document tray. The document sensor 21 is arranged near a lead end of the document tray 110. The document sensor 21 is e.g., a reflective type photosensor including a light emitter and a light receiving portion, and is adapted for detecting whether a document is placed on the document tray 110.

The document transport assembly 25 (see FIG. 1) includes the document feeding roller 121, a pair of document registration rollers 122, the document transport belt 13, a document discharge roller 14, and document inverting portions 151 and 152. The document feeding roller 121 is arranged at an appropriate position above the lead end of the document tray 110. When a document or a pile of documents is or are set on the document tray 110, the feeding roller 121 comes into contact with the document or the uppermost document to feed the document forward in the document transport direction. The document is then transported to a specified position on the document glass plate 7 by the registration roller pair 122 and the transport belt 13.

An image of the document transported onto the document glass plate 7 is scanned by the optical system 50. Thereafter, the document is discharged onto the document discharge portion 17 or 18 by the transport belt 13 and the document discharge roller 14.

In the case where an image on one surface of the document is to be scanned, the document has its transport direction inverted at the inverting portions 151 and 152 and is discharged onto the document discharge portion 17 with the document image facing upward. On the other hand, in the case where images on both surfaces of the document are to be scanned, after having the image on the one surface scanned on the document glass plate 7, the document has its transport direction inverted at the inverting portions 151 and 152, and then is placed back again on the document glass plate 7 with the image on the other surface thereof facing the glass plate 7 this time. After having the image on the other surface scanned on the glass plate 7, the document is transported downstream by the inverting portion 151 without having its transport direction inverted, and is discharged onto the document discharge portion 18 with the image on the one surface facing upward.

The document transport unit 10 further includes sensors 22, 23, and 24 arranged at specified positions along a transport path for documents to detect the document being transported. The sensor 22 (registration sensor) is arranged right downstream of the registration roller pair 122 with respect to the document transport direction to detect the document being transported by the registration roller pair 122, the sensor 23 (inverting sensor) is arranged downstream of the transport belt 13 with respect to the document transport direction to detect the document being transported with its transport direction inverted, and the sensor 24 (discharge sensor) is arranged right downstream of the discharge roller 14 and right upstream of the document discharge portion 17 with respect to the document transport direction to detect the document being discharged by the discharge roller 14. The sensors 22, 23 and 24 each include a detector piece and a sensing member. In this embodiment, when the sensor is in an OFF-state, the detector piece is projected by a specified height from the document transport path. When a document is transported and comes into contact with the projecting detector piece, the detector piece is rotated forward in the document transport direction (i.e., turning on of the detector piece), which is detected by the sensing member. Upon the document passing through the sensor, the sensor is returned to the OFF-state where the detector piece is projected by the specified height. The sensor is constructed in such a manner that the sensing member detects a lead end of the document upon the detector piece being turned on (i.e., brought to a rotatable state), while the sensing member detects a trail end of the document upon the detector piece being turned off (i.e., returned to the projecting state).

The sheet storage portion 30 comprises cassettes 31, 32, and 33, and a manual insertion portion 34. Each cassette is internally provided with a sheet aligning member 40 for placing a stack of copy sheets of a specified size in a vertical alignment manner. The sheet aligning member 40 is made vertically movable between a sheet dispense position where the stack of copy sheets are dispensed one by one to the main body 1 and a sheet replenishing position where sheets of copy paper are replenished with when the corresponding cassette runs short of copy paper. The sheet dispense position is located at an upper position of the cassette, while the sheet replenishing position is located at a lower position of the cassette.

When the sheet aligning member 40 is at the sheet dispense position, and an uppermost sheet of stacked copy paper is brought into contact with a corresponding sheet feeding roller 41 in a rotating state, the copy sheet is fed to the main body 1 by the rotation of the feeding roller 41. In this way, copy sheets stacked in the cassettes 31, 32, and 33 are dispensed one by one by the rotation of the corresponding feeding roller 41 and fed to the main body 1. The manual insertion portion 34 includes a manual insertion tray 341. When an uppermost sheet of stacked copy paper which are manually set on the manual insertion tray 341 is brought into contact with the corresponding feeding roller 41 in a rotating state, the copy sheet is fed to the main body 1 by the rotation of the feeding roller 41. Thus, the sheets of copy paper stacked on the tray 341 are dispensed one by one and fed to the main body 1.

The cassettes 31, 32, and 33, and the manual insertion portion 34 each include a sheet sensor 38 for detecting a copy sheet dispensed therefrom. The sheet sensor 38 is arranged at a specified position in an outlet of the cassettes 31, 32, and 33 and of the manual insertion portion 34. The outlet opens toward a transport path for the copy sheets. More specifically, in this embodiment, the sheet sensor 38 includes a detector piece and a sensing member. When the sensor is in an OFF-state, the detector piece is projected by a specified height from the sheet transport path. When a copy sheet is dispensed and comes into contact with the projecting detector piece, the detector piece is rotated forward in the sheet transport direction (i.e., turning on of the detector piece), which is detected by the sensing member. Upon the copy sheet passing through the sensor, the sensor is returned to the OFF-state where the detector piece is projected by the specified height. The sensor is constructed in such a manner that the sensing member detects a lead end of the copy sheet upon the detector piece being turned from an OFF-state to an ON-state (i.e., brought to the rotatable state), while the sensing member detects a trail end of the copy sheet upon the detector piece being turned from an ON-state to an OFF-state (i.e., returned to the projecting state).

The optical system 50 comprises a light source including an exposure lamp 51 and a reflector 52, mirrors 53*a*, 53*b*, 53*c*, 53*d*, 53*e*, 53*f*, and a lens unit 54. The light source and the mirrors 53*a*, 53*b*, 53*c* are reciprocally movable in sideways directions of the apparatus at a specified speed. A document image is scanned by the reciprocal movement of the light source and the mirrors to thereby form an optical image of the document image.

The imaging assembly 60 includes a photosensitive member 61 in the form of a drum. The photosensitive drum 61 is rotatably supported. The imaging assembly 60 is further arranged with a main charger 62, a developing unit 63, a transferring/separating unit 64, a cleaning unit 65, and a blank lamp 66 in the periphery of the photosensitive drum 61 along a rotational direction of the photosensitive drum 61 in this order. The main charger 62 uniformly charges a surface of the photosensitive drum 61 at a specified potential. A specified area of the surface of the photosensitive drum 61 right downstream of the main charger 62 is exposed, and an optical image of a document introduced to the drum surface is exposed at the surface area of the photosensitive drum 61 to thereby form an electrostatic latent image thereon. The electrostatic latent image is developed into a toner image by the developing unit 63 by electrically attracting toner particles to the charged latent image. The transferring/separating unit 64 transfers the toner image developed on the drum surface onto a copy sheet which is being transported to the surface of the photosensitive drum 61 as timed with the developing process, and separates the copy sheet carrying the toner image from the surface of the photosensitive drum after the image transfer process. The cleaning unit 65 removes toner particles remaining on the surface of the photosensitive drum 61. The blank lamp 66 removes unnecessary electric charges remaining on the drum surface.

The sheet transport assembly 70 comprises a pair of sheet transport rollers 71, a pair of sheet feeding rollers 74, a pair of sheet registration rollers 75, and a sheet transport belt 76 along the sheet transport direction in this order. The sheet transport roller pair 71 transports a copy sheet dispensed from the sheet storage portion 30 toward the photosensitive drum 61. The registration roller pair 75 is driven as timed with a scanning timing of the optical system 50. The transport belt 76 transports the copy sheet separated from the photosensitive drum 61 to the fixing unit 80.

Switches 72 and 73 are arranged at the upstream side and downstream side of the feeding roller pair 74, respectively. The switch 72 is adapted for detecting the copy sheet which is transported by the feeding roller pair 74, while the switch 73 is adapted for detecting the copy sheet which is transported further downstream by the registration roller pair 75.

The fixing unit 80 comprises a heating roller 81 and a pressing roller 82. The heating roller 81 is covered with e.g., teflon rubber and is internally provided with a heater 83. A temperature sensor 84 is arranged at an appropriate position in a periphery of an outer surface of the heating roller 81. The pressing roller 82 is covered with a material softer than the surface of the heating roller 81, e.g., with silicone rubber. The pressing roller 82 is pressed against the heating roller 81 with a specified pressure.

The heater 83 is connected to a power supply 85 which outputs a voltage of a specified level via a drive circuit 86 (see FIG. 1) including a relay circuit. The heater 83 is adapted for heating the heating roller 81 at a predetermined temperature. The temperature sensor 84 includes a thermistor and is adapted for detecting the temperature of the outer surface of the heating roller 81.

At the downstream of the fixing unit 80 provided are a pair of sheet transport rollers 77 for transporting a copy sheet after a fixing process and a pair of sheet discharge rollers 78 for discharging the copy sheet to the sorter 100.

Between the sheet transport roller pair 77 and the sheet discharge roller pair 78 arranged is a junction 91 for selectively transporting the copy sheet to the sorter 100 or to the duplex copy portion 90.

A copy sheet for a duplex copying is selectively transported to the duplex copy portion 90 by the junction 91, guided along a sheet transport inlet 92 and temporarily stored in a sheet inverting portion 93. Then, the copy sheet temporarily stored in the sheet inverting portion 93 is guided again to the photosensitive drum 61 via a sheet transport outlet 94.

The sorter 100 comprises a junction 101, an unshiftable bin tray 102 and a plurality of unillustrated shiftable bin trays for sorting out sheets of copy paper after an image formation. By selectively switching the junction 101, the copy sheet or sheets after an image formation is or are discharged onto the bin tray 102 or the unillustrated bin trays for sorting. The sorter 100 includes an unillustrated elevating mechanism. The elevating mechanism shifts the unillustrated bin trays one after another upward or downward as timed with a discharging operation of copy sheets from the apparatus main body 1 to discharge the copy sheets onto the bin trays one by one.

Figure 1:
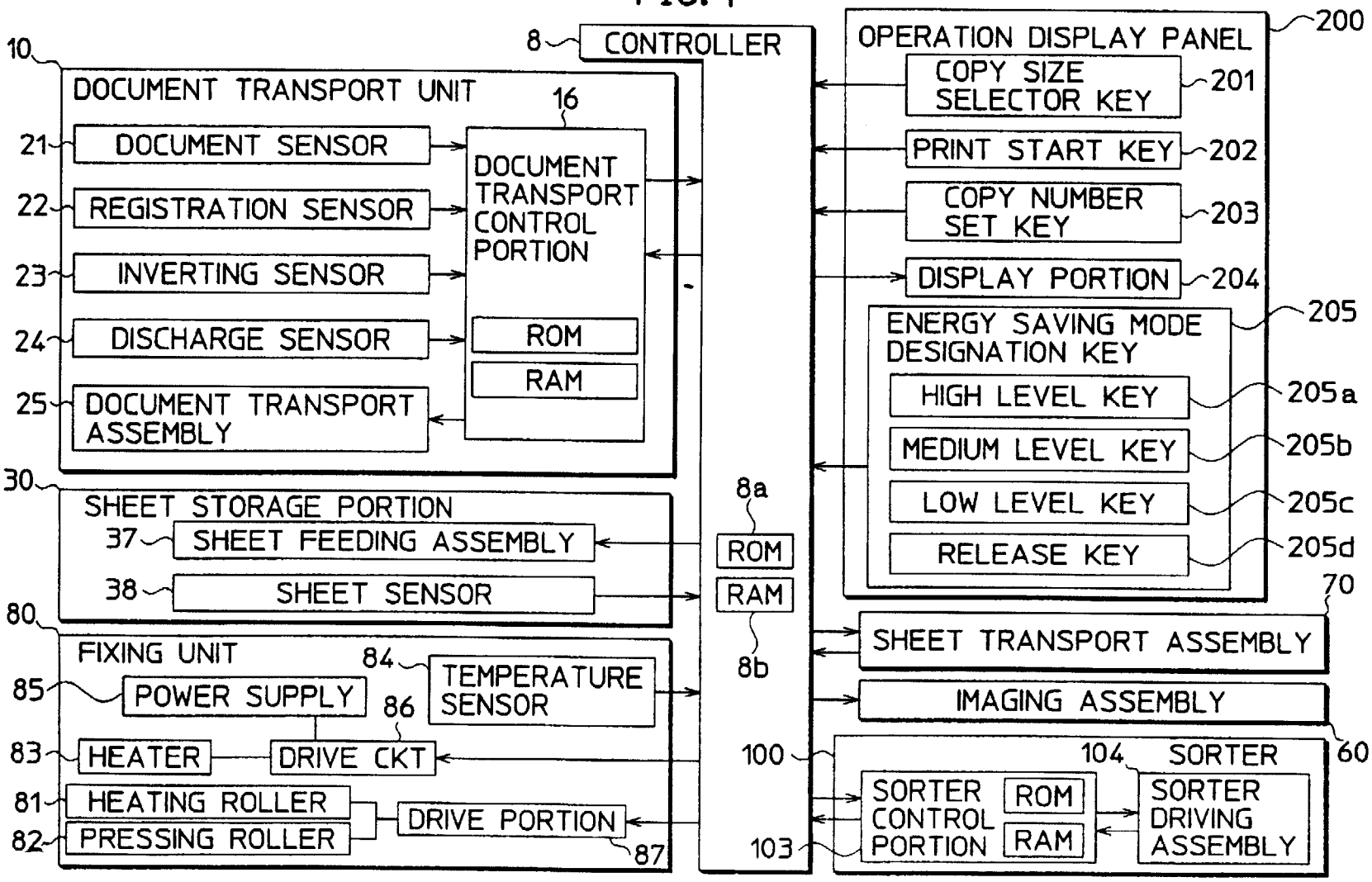
FIG. 1 is a block diagram showing a control system of an image forming apparatus embodying the present invention.

A control system of the image forming apparatus of the present invention will be described with reference to a block diagram in FIG. 1.

The image forming apparatus comprises a controller 8 for controlling an overall operation of the apparatus main body 1, a document transport control portion 16 for controlling the document transport unit 10, and a sorter control portion 103 for controlling the sorter 100. The controller 8 serially communicates with the document transport control portion 16 and the sorter controller portion 103 by sending and receiving various data and operation timing signals to thereby control operation of the respective control portions.

The operation display panel 200 includes a copy sheet size selector key 201, print start key 202, various setting keys such as copy number set key 203, copy magnification set key, energy saving mode designation key portion 205, and a display portion 204. With the copy sheet size selector key 201, the size of copy sheets is selected and the cassette containing copy sheets of the selected size is selected from among the cassettes 31, 32, 33 and the manual insertion portion 34. When the print start key 202 is depressed, a copying operation is started. With the copy number set key 203, a number of copies for a document image is set.

The energy saving mode designation key portion 205 includes a high level key 205*a*, a medium level key 205*b*, a low level key 205*c*, and an energy saving mode release key 205*d*. By turning on or off the energy saving mode release key 205*d*, the temperature of the heating roller 81 in the fixing unit 80 is selectively operated either in an energy saving mode or in an operational mode. The energy saving mode and the operational mode will be described later.

The display portion 204 is, e.g., a liquid crystal panel or a light emitting diode (LED), and is adapted for displaying copy size selected by the copy size selector key 201, number of copies set by the copy number set key 203, copy magnification set by the copy magnification set key. The display portion 204 also displays that the energy saving mode has been designated upon the fixing unit 80 entering into the energy saving mode, and further displays the level of energy saving selected by the level keys.

It should be appreciated that the energy saving mode designation key portion 205 includes a selector key and a setting key. Each time the selector key is depressed, the display portion 204 cyclically displays the high level, medium level and low level of energy saving. When the setting key is depressed, the displayed level of the energy saving mode is set, and the fixing unit 80 enters into the energy saving mode.

The document transport control portion 16 comprises a microcomputer internally provided with an KOM for storing a control program of the document transport unit 10 and an RAM for temporarily storing data to control various operations of the document transport assembly 25. Further, the document transport control portion 16 counts a time lasting from a timing at which the sensor 22 detects a leading end of a transported document to a timing at which the sensor 22 detects a trail end of the transported document during a feeding operation of the document, and judges that a jam occurs during the feeding operation of the document if the counted time exceeds a predetermined time.

The document transport control portion 16 further counts a time lasting from a timing at which the sensor 23 detects the leading end of the transported document to a timing at which the sensor 23 detects the trail end of the transported document during an inverting or discharging operation of the document, and judges that a jam occurs in the inverting operation of the document if the counted time exceeds a predetermined time. The document transport control portion 16 further counts a time lasting from a timing at which the sensor 24 detects the leading end of the transported document to a timing at which the sensor 24 detects the trail end of the transported document during a discharging operation of the document onto the document receiving portion 17, and judges that a jam occurs in the discharging operation of the document if the counted time exceeds a predetermined time.

Further, the document transport control portion 16 sends information to the controller 6 to the effect that a jam occurs during a transport of document and regarding the kind of jam.

The controller 8 comprises a microcomputer internally provided with an ROM 8*a* for storing a control program of the apparatus main body 1 and an RAM 8*b* for temporarily storing data. When the print start key 202 is depressed, the controller 8 renders the apparatus main body 1 start a copying operation. The controller 8 controls various operations of the optical system 50, the imaging assembly 60 and the sheet transport assembly 70 based on contents set by the various setting keys such as the magnification set key. Also, the controller 8 controls various operations of the sheet storage portion 30 based on contents selected by the copy size selector key 201. Further, the controller 8 controls the rotation of the heating roller 81 and the pressing roller 82 via a drive portion 87 including a drive motor.

The controller 8 controls the drive circuit 86 in accordance with the temperature of the heating roller 81 detected by the temperature sensor 84 and controls on and off of the power supply 85 by allowing the power supply 85 to flow or suspend flowing electric current through the heater 83. The controller 8 switchingly controls the fixing unit 80 so that the fixing unit 80 is operated in the operational mode or in the energy saving mode.

The operational mode will be described next. The operational mode is a mode which maintains the temperature of the heating roller 81 at a predetermined temperature suitable for a fixing operation (hereinafter referred to as a "fixing temperature"). Unless otherwise designated, the apparatus main body 1 is operated at this operational mode. In this embodiment, the fixing temperature is set at 200°±1° C.

During the operational mode, the fixing temperature is maintained at the predetermined value by the following operation. Specifically, the controller 8 controls the drive circuit 86 so that the power supply 85 is alternately turned on and off, namely, alternately flows and suspends flowing electric current through the heater 83, thereby repeatedly heating and suspending heating the heater 83. More specifically, the controller 8 controls the drive circuit 86 to turn off the power supply 85 so as to suspend flowing of electric current through the heater 83 upon the temperature sensor 84 detecting that the temperature of the Heating roller 81 coincides with a set upper limit temperature (201° C.) of the fixing temperature. Thereby, the heating operation of the heater 83 is suspended, and the temperature of the heating roller 81 is lowered from the upper limit temperature. As the temperature of the heating roller 81 is lowered, the temperature sensor 84 detects a set lower limit temperature (199° C.) of the fixing temperature. Thereupon, the controller 8 controls the drive circuit 86 to turn on the power supply 85 to thereby allow the power supply 85 to start flowing electric current through the heater 83 in order to heat the heater 83 again. Accordingly, the temperature of the heating roller 81 is raised. By repeatedly controlling on and off of the power supply 85 in the fixing unit 80, the temperature of the heating roller 81 is maintained at the fixing temperature of 200° C.

The energy saving mode is a mode for suppressing energy consumption in a stand-by state of the apparatus main body 1 by maintaining the temperature of the heating roller 81 in a predetermined range. When either one of the high level key 205*a*, medium level key 205*b* or low level key 205*c* in the energy saving mode designation key portion 205 is designated and set, the temperature control of the fixing unit 80 is selectively switched to the energy saving mode from the operational mode, and hence, the temperature of the fixing unit 80 is lowered from the fixing temperature of 200°±1° C. to a first saving temperature of e.g., 190°±1° C., to a second saving temperature of e.g., 182°±1° C., or to a third saving temperature of e.g., 160°±1° C. More specifically, either one of the high level key 205*a*, medium level key 205*b*, and low level key 205*c* in the energy saving designation mode key portion 205 is designated and set, the controller 8 controls on and off of the power supply 85 and allows the power supply 85 to flow or suspend flowing electric current through the heater 83 so as to selectively maintain the temperature of the heating roller 81 at one of the first to third saving temperatures.

For example, when the high level key 205*a* is selected, the controller 8 controls the drive circuit 86 to turn off the power supply 85 so that flowing of electric current through the heater 83 is suspended, thereby suspending heating operation of the heater 83. Consequently, the temperature of the heating roller 81 is lowered from the fixing temperature. Upon the temperature sensor 84 detecting that the temperature of the heating roller 81 coincides with a set lower limit temperature (189° C.) of the first saving temperature (190°±1° C.), the controller 8 controls the drive circuit 86 to turn on the power supply 85 so that the flowing of electric current through the heater 83 is restarted, thereby raising the temperature of the heating roller 81. When the temperature of the heating roller 81 is raised from the set lower limit temperature, and the temperature sensor 84 detects a set upper limit temperature (191° C.) of the first saving temperature, the controller 8 controls the drive circuit 86 to render the power supply 85 suspend the flowing of electric current through the heater 83, thereby suspending the heating operation of the heater 83. Accordingly, the temperature of the heating roller 83 is lowered from the set upper limit temperature of the first saving temperature. Thus, by repeating the above on and off control of the power supply 85, the temperature on the surface of the heating roller 81 is maintained at the first saving temperature of 190°±1° C.

It should be appreciated that on-off control of the medium level key 205*b* and low level key 205*c*, namely, switching control in the second and third saving temperatures is conducted in the similar manner as the on-off control of the high level key 205*a*, and hence the description thereof will be omitted.

When the release key 205*d* is depressed, the fixing unit 80 goes out of the energy saving mode and is returned to the operational mode. Specifically, when the release key 205*d* is depressed, the controller 8 causes the power supply 85 to flow electric current through the heater 83, thereby heating the heater 83. Consequently, the temperature of the heating roller 81 is raised. When the temperature of the heating roller 81 detected by the temperature sensor 84 coincides with the set upper limit temperature (201° C.) of the fixing temperature, the controller 8 causes the power supply 85 to suspend the flowing of electric current through the heater 83. Thus, the temperature of the heating roller 81 is maintained at the predetermined range of fixing temperature.

In the foregoing embodiment, the upper limit and lower limit temperature of the fixing temperature and the first to third saving temperatures are respectively set in the range of ±1° C. However, this range is variable according to needs.

TABLE-1 shows an example of a relationship between the saving temperature of the heating roller 81 and a time required for returning the temperature of the heating roller 81 from the respective saving temperatures to the fixing temperature (200° C.) when the high level key 205*a*, medium level key 205*b*, and low level key 205*c* are selected.

TABLE 1

| SAVING MODE | SAVING TEMPERATURE (°C.) | TIME (SEC) |
|---|---|---|
| HIGH LEVEL | 190 | 30 |
| MEDIUM LEVEL | 182 | 60 |
| LOW LEVEL | 160 | 120 |

In the case where the temperature of the heating roller 81 is maintained at the respective saving temperatures shown in TABLE-1, energy saving of 10%, 50% and 80% in the high level, medium level, and low level respectively can be attained compared to the case where the heating roller 81 is maintained at the fixing temperature in a stand-by state of the image forming apparatus.

When the fixing unit 80 is entered into the energy saving mode, the controller 8 inhibits the apparatus to start a copying operation even if the print start key 202 is depressed. Thus, prevented is a likelihood that a copying operation is inadvertently executed in a state that the heating roller 81 has not reached the fixing temperature, which results in a failure of copying.

When the release key 205*d* is depressed during the energy saving mode to return the fixing unit 80 to the operational mode from the energy saving mode, and the print start key 202 is depressed, the controller 8 renders the apparatus main body 1 wait for a specified time for a copying operation until the temperature of the heating roller 81 is returned to the fixing temperature. In other words, the controller 8 renders the apparatus main body 1 start the copying operation only after the temperature of the heating roller 81 is returned to the fixing temperature. Thus, an occurrence of a copying failure can be reliably prevented. Further, an operator can perform other tasks after depressing the print start key 202 without waiting for a time until the temperature of the heating roller 81 returns to the fixing temperature, because he or she does not have to depress the print start key 202 after confirming that the temperature of the heating roller 81 is returned to the fixing temperature. This is advantageous in the aspect of workability.

Further, in the case where the print start key 202 is depressed during the energy saving mode, it may be appreciated that the fixing unit 80 goes out of the energy saving mode and returns to the operational mode and that the apparatus waits for a specified time until the temperature of the heating roller 81 is returned to the fixing temperature, whereupon a copying operation is started. In this case, the release key 205*d* can be omitted. This is advantageous in that a number of parts can be reduced as well as avoiding a copying failure.

The sorter control portion 103 comprises a microcomputer internally provided with an KOM for storing a control program of the sorter 100 and an RAM for temporarily storing data. The sorter control portion 103 controls various operations of a sorter driving assembly 104 comprising transport roller pairs in the sorter 100, the elevating mechanism, and the junction 101.

Next, an operation of the image forming apparatus having the above construction will be described.

After the operation display panel 200 displays set copying magnification, number of copies for a document image set by the copy number set key 203, and size of copy paper set by the copy size selector key 201, and the print start key 202 is depressed, a copying operation is started.

A document placed on the document tray 110 is fed to a specified position on the document glass plate 7. A light emitted from the light source is reflected by the document placed on the document glass plate 7 to form an optical image from a document image, and the optical image is introduced to the lens unit 54 via the mirrors 53*a* to 53*c*. Thereafter, the optical image is exposed on a surface of the photosensitive drum 61 via the mirrors 53*d* to 53*f*.

At this time, the surface of the photosensitive drum 61 is uniformly charged by the main charger 62, and a specified area of the surface of the photosensitive drum 61 on which the document image is to be transferred is exposed by the optical assembly 50 to form an electrostatic latent image. Subsequently, charged toner particles supplied from the developing unit 63 are attracted to the electrostatic latent image to thereby develop the latent image into a toner image.

On the other hand, a sheet of copy paper dispensed from the sheet storage portion 30 is fed by a sheet feeding assembly 37 in the sheet storage portion 30 (see FIG. 1) and then transported to the registration roller pair 75 by the sheet transport assembly 70. Then, the thus transported copy sheet is further transported downstream between the surface of the photosensitive drum 61 and the transferring/separating unit 64 as timed with a scanning operation of the optical system 50.

The transported copy sheet has the toner image formed on the surface of the photosensitive drum 61 transferred thereto and is separated therefrom by the transferring/separating unit 64. The copy sheet separated from the transferring/separating unit 64 is transported to the fixing unit 80 by the sheet transport belt 76. In the fixing unit 80, the copy sheet has its toner image fixed to a surface thereof with heat of the heating roller 81 and a pressure of the pressing roller 82, while being transported in a nipped state between the rotating rollers 81 and 82 driven by the drive portion 87 (see FIG. 1). The copy sheet after the fixing process is transported downstream by the sheet transport roller pair 77, and discharged to the sorter 100 by e.g., the sheet discharge roller pair 78.

After the above copying operation for the present document image is repeated the number of times identical to the number of copies set by the copy number set key 203, the document transport unit 10 is operated to allow the document placed on the document glass plate 7 to be discharged, and a next document placed in the uppermost position on the document tray 110 is fed to the specified position on the document glass plate 7. Thus, a copying operation for a next document image is carried out in the similar manner as for the previous document image.

In the case where the apparatus is brought into a stand-by state for a relatively long time or is under non-frequent use, an operator can select a desirable level key from the high level key 205*a*, medium level key 205*b*, and low level key 205*c* in the energy saving mode key portion 205, thereby suppressing the temperature of the heating roller 81 at the first, second or third saving temperature. In this case, the low level key 205*c* is selected when energy saving is put as a priority. When shortening a time required for returning the apparatus to an operable state where a desirable image formation is attainable is put as a priority, the high level key 205*a* is selected. When there is no priority, the medium level key 205*b* is selected.

According to the embodiment of the present invention, the energy saving mode key portion 205 is provided with the high level key 205*a*, medium level key 205*b*, and low level key 205*c* so that the temperature of the heating roller 81 in the energy saving mode can be selectively set at one of the plurality of saving temperature levels. Accordingly, the operator can make a priority according to needs between energy saving and shortening a time required for returning the apparatus to an operable state for a desirable image formation. Hence, compared to the conventional fixing unit of an image forming apparatus in which energy saving performance becomes poor if a time required for returning the apparatus to an operable state is shortened to a great extent, because there is only one level in the energy saving mode, according to the embodiment of the present invention, energy saving performance can be enhanced, because there are a plurality of energy saving levels.

In the foregoing embodiment, there are three kinds of saving temperatures. However, the present invention is not limited to the foregoing, but two or more than three kinds of saving temperatures can be set.

Although the present invention has been fully described by way of example with reference to the accompanying drawings, it is to be understood that various changes and modifications will be apparent to those skilled in the art. Therefore, unless otherwise such change and modifications depart from the scope of the invention, they should be construed as being included therein.

What is claimed is:

1. A temperature controlling device for controlling the temperature of a heating member of a fixing unit of an image forming apparatus, the heating member being heated by a heater to perform a fixing operation at a predetermined fixing temperature, the temperature controlling device comprising:

a controller means for maintaining a temperature of the heating member within a predefined range of one of said predetermined fixing temperature when said image forming apparatus is in an operational mode for making copies, and a first energy saving temperature lower than said predetermined fixing temperature and a second energy saving temperature lower than said first energy saving temperature when said image forming apparatus is in a standby mode for energy saving operation wherein copies are not to be made, said controller means maintaining said temperature of the heating member by regulating power to the heater; and said controller including a selection means for selecting one of said first energy saving temperature and said second energy saving temperature for use during said standby mode.

2. A temperature controlling device as defined in claim 1, wherein said selection means includes:

a first designating member for designating the first energy saving temperature in response to operator actuation; and a second designating member for designating the second energy saving temperature in response to operator actuation.

3. A temperature controlling device as defined in claim 2, wherein the controller further includes a releasing member for releasing of the designation of the first designating member and the second designating member to effect maintenance of said heating member within said predefined range of said predetermined fixing temperature in response to operator actuation to maintain said heating member in said operation mode for making copies.

4. A temperature controlling device for controlling the temperature of a heating member of a fixing unit of an image forming apparatus, the heating member being heated by a heater to perform a fixing operation at a predetermined fixing temperature, the temperature controlling device comprising:

a controller means for controlling the heater by regulating power applied thereto to maintain a temperature of the heating member within a predetermined range one of a first energy saving temperature and a second energy saving temperature during a standby mode of the image forming apparatus, for effecting energy savings during which time copies are not to be made, after expiration of a predetermined time period following an image forming operation, wherein the first saving temperature is lower than the predetermined fixing temperature and the second energy saving temperature is lower than the first energy saving temperature; and said controller including means for controlling the heater to return said temperature of said heating member to within a predefined range of said predetermined fixing temperature upon initiation of a copying operation while delaying execution of said copying operation until said temperature of said heating member reaches said predefined range of said predetermined fixing temperature thus placing said heating member in an operable condition for making copies.

5. A temperature controlling device as defined in claim 4, wherein the heater at the first energy saving temperature consumes a certain power and the heater at the second energy saving temperature consumes a power less than the certain power and the heater at the second energy saving temperature requires longer time to restore the predetermined fixing temperature than the heater at the first energy saving temperatures does in response to a supply of a predetermined power.

* * * * *